United States Patent [19]

Howard

[11] Patent Number: 4,903,640

[45] Date of Patent: Feb. 27, 1990

[54] PANEL ADAPTED FOR COOLANT THROUGH FLOW, AND AN ARTICLE INCORPORATING SUCH PANELS

[75] Inventor: Peter R. Howard, Sheffield, England

[73] Assignee: P. Howard Industrial Pipework Services Limited, Sheffield, England

[21] Appl. No.: 183,917

[22] Filed: Apr. 20, 1988

[51] Int. Cl.[4] ..... F22B 37/00

[52] U.S. Cl. ..... 122/6 A; 122/6 C; 122/499; 432/237; 165/168; 266/190; 266/194

[58] Field of Search ..... 122/6 B, 6 R, 499, 6 C, 122/6 A; 110/175 R, 180; 432/237; 165/168; 266/193, 190, 194

[56] References Cited

U.S. PATENT DOCUMENTS

| | | | |
|---|---|---|---|
| 452,607 | 5/1891 | Hunt | 122/6 B |
| 515,694 | 2/1894 | Rotthoff | 122/6 B |
| 1,707,242 | 4/1929 | Wildermuth | 122/6 C |
| 2,053,540 | 9/1936 | Stoneman, Jr. | 165/168 |
| 2,919,683 | 1/1960 | Reighart | 122/6 C |
| 3,106,911 | 10/1963 | Traina | 122/499 |

FOREIGN PATENT DOCUMENTS

| | | | |
|---|---|---|---|
| 3414861 | 10/1985 | Fed. Rep. of Germany | 432/237 |
| 1558040 | 12/1979 | United Kingdom | 122/6 A |

*Primary Examiner*—James C. Yeung

*Attorney, Agent, or Firm*—R. A. Giangiorgi; Trexler, Bushnell, Giangiorgi & Blackstone

[57] ABSTRACT

A panel 1, 1A, adapted for the flow of coolant, therethrough, comprising coolant flow tubing having a coolant inlet aperture 11C at an inlet end of the coolant flow tubing and a coolant outlet aperture 12A at an outlet end of the coolant flow tubing, characterized in that the coolant flow tubing comprising a plurality of elongate tube lengths 2, 2A, 2B formed from hollow rectangular section material, the tube lengths 2, 2A, 2B being disposed in parallel relationship, either stacked one on top of the other or side-by-side, with adjacent external faces of adjacent top and bottom walls 3, 4 of adjacent tube lengths 2, 2A, 2B abutting one another, with the end of each tube length 2, 2A, 2B closed off, and with coolant flow apertures 11, 11A, 11B, 12, 12A, 12B communicating between adjacent tube lengths 2, 2A, 2B adjacent the ends thereof such that, in use, coolant flows in at one end of each tube length, along the tube length, and out at the other end of each tube length, to and through successive tube lengths of the panel 1, 1A.

10 Claims, 5 Drawing Sheets

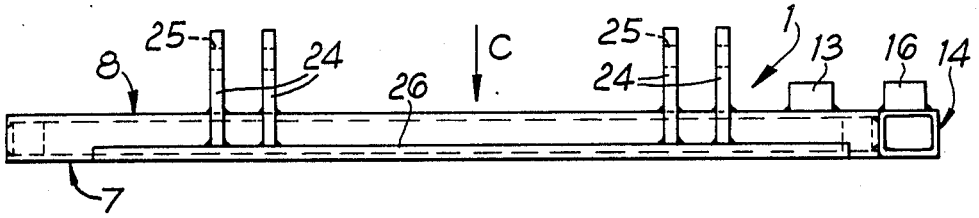
Fig. 4
Fig. 5
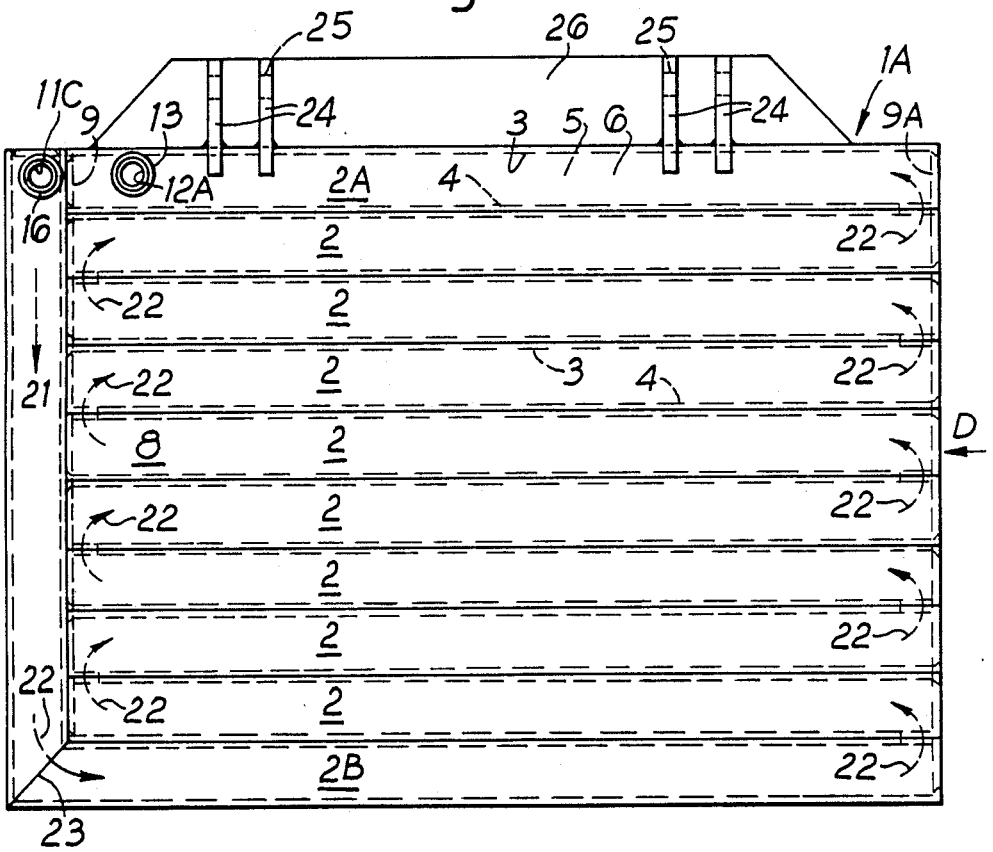

PANEL ADAPTED FOR COOLANT THROUGH FLOW, AND AN ARTICLE INCORPORATING SUCH PANELS

This invention relates to a panel adapted for the flow therethrough of a coolant such as air or water, and to an article such as an electric arc furnace or cooling tank incorporating such panels.

Such a panel may be used for instance, to define an interior wall of a furnace, e.g. an electric arc furnace, as a replacement, in part, for relatively expensive refractory material. Alternatively, such a panel could be used as, or to form part of, a furnace door or roof, but irrespective of its particular use, the purpose of the furnace panel is to form a barrier between a hot zone within a furnace and an ambient cooler zone, with the coolant prolonging the service life of the panel. Alternatively, the panel may be employed to cool a liquid or gaseous medium such as hot oil or hot air, e.g. by immersing the panel in the hot oil etc., or by constructing an oil tank from a number of such panels.

For furnace use, known panels are generally rectangular if they are intended to constitute a door or a portion of a furnace wall, or are segmental if they are to constitute a portion of the roof of a circular, electrical arc furnace. However, irrespective of the overall panel shape, one panel construction currently in use comprises sinuously arrayed, circular section, water flow tubing extending over the entire area of the panel. The tubing thus comprises a plurality of parallel horizontally extending tube portions closely spaced with respect to one another and welded one above the other (insofar as a furnace door or wall portion is concerned) between the bottom and top of the panel, with the horizontal tube portions approximating in length to the width of the panel, and with 180° return bends at the ends of the horizontal tube portions. As tube of requisite cross-section and wall thickness is available from manufacturers in finite lengths $<6$ m, it follows that sinuous tubing of say 40 m total length must incorporate a number of butt joints e.g., 6 to 8 joints (even when using 6 m long tubes) between adjacent tube ends. The butt joints are normally disposed down the centre of the panel, and, and form electric furnace walls the panels subsequently need to be bent to arcuate shape but such bending disadvantageously stresses these butt joints which often results in premature failure or water leakage at these joints. An inlet pipe is of course required to convey cooling water to an inlet end of the sinuous tubing, and an outlet pipe to convey water from an outlet end of the sinuous tubing. Apart from having a disadvantageously short service life, such furnace panels are expensive to fabricate in that, because of the use of circular section tubing, specially profiled in-fill pieces must be employed between adjacent external peripheries of adjacent horizontal tube lengths, with two adjacent horizontal tube portions welded to opposite edges of a common in-fill piece, while furthermore, differential expansion and contraction between horizontal tube portions and in-fill pieces frequently results in unsatisfactory welds. Equipment is also required to provide the 180° return bends between one horizontal tube portion and the adjacent horizontal tube portion. In addition, the use of circular section tubing presents an irregular surface to the inside of the furnace, and consequently a discontinuous presentation of cooling water to the inside of the furnace.

Another furnace panel from practice is a so-called box panel, being constructed from a back sheet, to an inner face of which are welded fins defining a coolant flow path, with the panel and flow paths completed by welding a front sheet to and over the fins. Such a panel, to form part of a furnace wall, also needs to be bent to the curvature of the particular furnace involved, but is prone to relatively short service life, to coolant leakage and to distortion under service temperatures.

Another panel construction, known not from practice but from GB No. 1,558,040, describes the use of rectangular cross-section water cooling boxes, with each box having an individual water inlet connection at one end, and water outlet connection at the other end.

Basic objects of the present invention are to provide a construction of panel adapted for the flow of coolant therethrough, which is considerably simpler and hence cheaper to manufacture, which has a greater rate of heat transfer and which extended service life, compared with known panels.

According to a first aspect of the present invention, there is provided a panel, adapted for the flow of coolant therethrough, comprising coolant flow tubing having a coolant inlet aperture at an inlet end of the coolant flow tubing and a coolant outlet aperture at an outlet end of the coolant flow tubing, the coolant flow tubing comprising a plurality of elongate tube lengths formed from hollow rectangular section material, the tube lengths being disposed in parallel relationship, either stacked one on top of the other or side-by-side, with adjacent external faces of adjacent top and bottom walls of adjacent tube lengths abutting one another, with the end of each tube length closed off, and with coolant flow apertures communicating between adjacent tube lengths adjacent the ends thereof such that, in use, coolant flows in at one end of each tube length, along the tube length, and out at the other end of each tube length, to and through successive tube lengths of the panel.

Thus, the panel in accordance with the invention, when compared with the prior art sinuous tubing panel firstly enables in-fill pieces to be eliminated, resulting in a greatly simplified and more economical welding operation, whilst furthermore eliminates butt-joints along the centre of the panel, whilst in addition the flat nature of the external walls of the rectangular section tube lengths enables a flat face, which may be considered as a "hot" face, to be presented to the inside of e.g., the furnace or oil tank, and hence a greater area for presentation of coolant to the hot zone and hence enhanced heat transfer. Compared with the prior art box panel, the panel of the invention by employing hollow, rectangular section tube lengths benefits from the inherent strength of such tube lengths in resisting distortion in service and hence maintaining integrity of the panel not only in service, thereby avoiding troublesome coolant leakage particularly if the coolant is water, but also when being craned out of a furnace for repair or replacement, when coherent removal of the panel saves time and avoids danger to personnel if panel break-up occurs during craning. Finally, compared with GB No. 1,558,040, the panel of the invention, by incorporating coolant flow apertures between adjacent tube lengths, so that coolant may flow successively through the tube lengths, greatly simplifies the overall panel construction and hence reduces manufacturing, installation and removal costs, whilst simultaneously and significantly reducing the possibility of coolant leakage by providing but one cool ant inlet connection and but one coolant outlet connection.

According to a second aspect of the invention, there is provided an electric arc furnace incorporating panels in accordance with the first aspect.

According to a third aspect of the invention, there is provided a cooling tank incorporating panels in accordance with the first aspect.

The tube lengths can be produced in carbon steel or, for maximum life but at greater cost, in stainless steel. Alternatively, for specific duties copper, or metal alloy may be employed, but in principle, any material capable of withstanding the temperatures encountered in service may be employed. The tube lengths can be either of hollow rolled box section e.g. 120×80×10 mm or, less satisfactorily, could be fabricated to rectangular section from plates, and/or angles and/or channels. As rolled box sections conventionally have an internal seam, this is preferably arranged to be, in use, at the "cold" side or face of the panel.

Although the tube lengths could be secured at their ends to a common support plate extending the full length or depth of the panel, it is much preferred for the tube lengths to be secured together along mutually abutting longitudinal edges. Preferably, such securing is by welding, either continuously or by stitch welding. Certainly, continuous welding ensures adequate panel strength, particularly when suspended by crane during insertion or removal from a furnace.

Preferably, the panel is provided, at one lateral side, inlet tube length extending orthogonally, or generally so, with respect to the axes of the parallel tube lengths, which inlet tube length is also secured e.g. by welding, to the adjacent ends of the parallel tube lengths. If the panel is considered as located vertically as part of a furnace wall, the parallel tube lengths would be horizontal and the inlet tube length would be vertical so that coolant flow is into the upper end of the vertical tube length at which location the cooling water inlet aperture is provided, with the flow of cooling water being down the vertical tube length and into the bottom-most parallel tube length, with water flow then being successively up successive parallel tube lengths until the uppermost parallel tube length is reached, with water flow out of the panel being through the outlet aperture which is provided in the uppermost parallel tube length. A welded joint—either a mitre joint or a butt joint—would be required between the lower end of the (vertical) inlet tube length and the bottom-most parallel tube length. Such a joint could be avoided if the inlet tube length and bottommost parallel length are integral e.g. by forming both from one length circular section tubing with the joint replaced by a 90° bend. Preferably, the panel is provided at its rear "cold" face with a support plate, which is conveniently welded in position and provided with two spaced-apart and support members, also preferably welded in position, serving to locate or key the panel in its required position e.g., by apertures in the support members being lowered into engaging pins of the furnace structure. The panel is also provided with two coolant conveying pipes, one pipe being connected to the inlet aperture of the inlet tube length, and the other connected to the outlet aperture of the uppermost parallel tube length, respectively for conveying coolant from a pumping source to the panel, and heated coolant from the panel, the pipes, for a furnace panel, being of length such that they will pass through a steel shell located behind the panel.

For use as wall components of an electric furnace, the panels e.g., 2–3 m high and 2–3 m wide may each subtend an arc of 22° 30′, so that 16 such panels would be required to surround an electric furnace. It follows that the horizontal tube lengths need to be bent to a curvature appropriate to that of the particular electric furnace involved. For use as a slag door, the panel would not be curved but would be flat.

As a slag door or furnace wall component, the "hot" face of the panel may be provided with slag catching cups. These may be shallow, "U"-shaped steel members welded in position, preferably along the weld line between two adjacent, parallel tube lengths. Also when a furnace door or wall portion is involved, the lower part of the panel is subjected to higher temperatures than the upper part of the panel. It may be desirable therefore to have differential flow rates between the upper and lower parts. This could be achieved by having each part constitute an individual coolant flow circuit, with a greater flow rate through the lower part than the upper part. Flow rate variation may be achieved by using two pumps of the differing capacities, or a single pump with a restricted flow, such as a smaller diameter inlet pipe, to the upper part.

For use as part of a furnace roof, the panels would be segmental in plan, and dished so that all the segmental panels together formed a shallow, conical roof, whilst the parallel tube lengths would be arrayed side-by-side in this embodiment.

For use as a cooling panel e.g., for hot oil, the panel may be immersed in an otherwise conventional oil tank, e.g. a return tank of a hydraulic system. Alternatively, a return tank may be constructed using one or a multiple number of panels in accordance with the invention, dependent upon the rate of heat transfer required. Thus, a rectangular tank could be constructed using between one and five panels, the five panel version being four side walls and a tank bottom.

The invention will now be described in greater detail, by way of examples, with reference to the accompanying drawing, in which:

FIG. 4 is a plan view of a second embodiment of panel in accordance with the invention, for use as a slag door of a furnace;

FIG. 5 is view looking o the rear of the panel of FIG. 4 in the direction of arrow C;

In the drawings, like components, are accorded like reference numerals.

Figure 3:
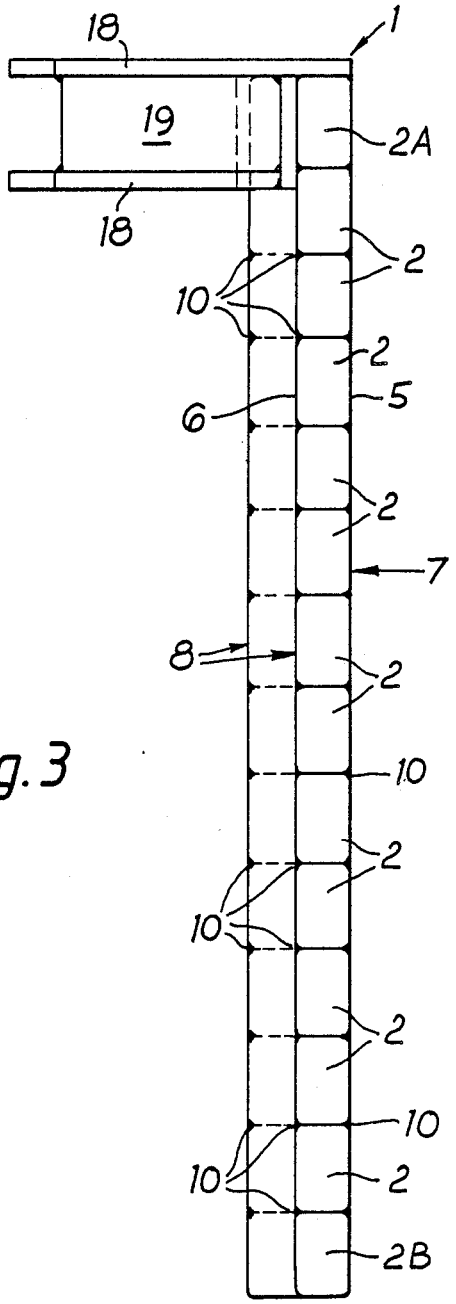
FIG. 3 is an end elevation of FIG. 1 in the direction of arrow B.
Figure 7:
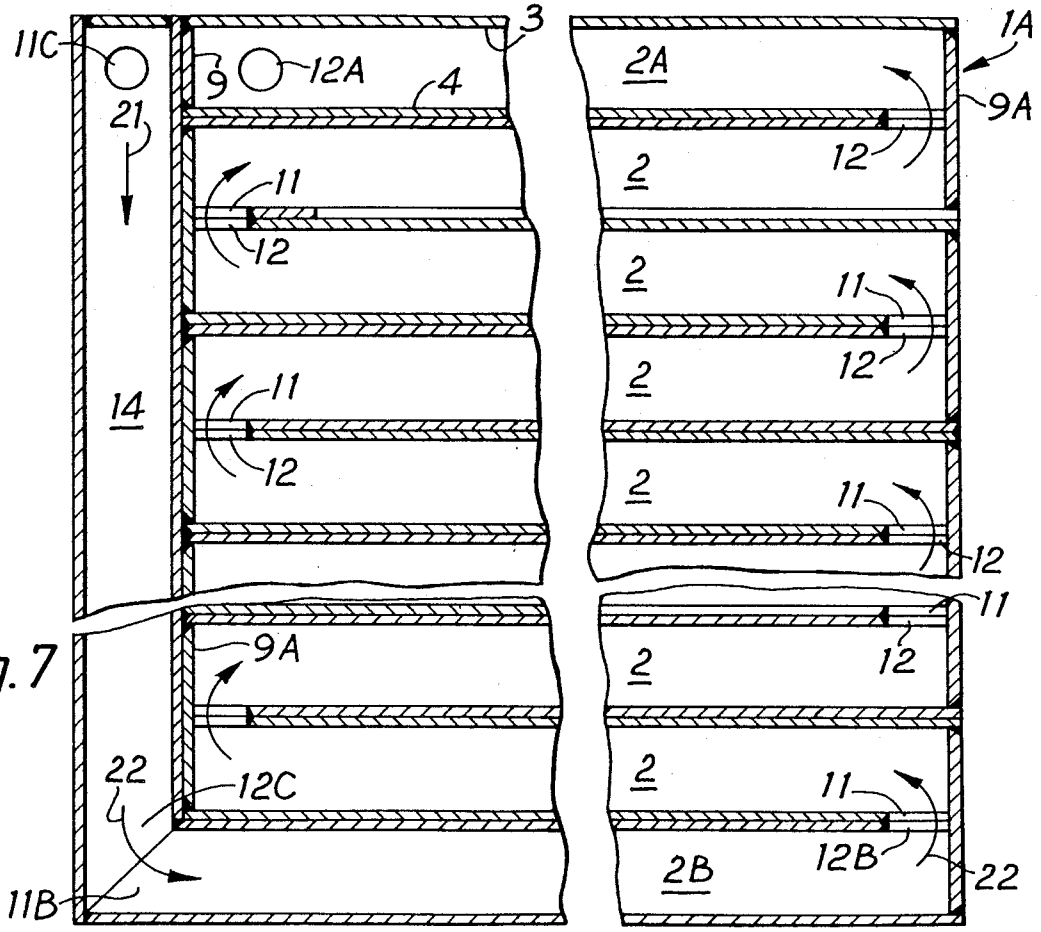
FIG. 7 is a part sectional view through a portion of FIG. 4.
Figure 6:
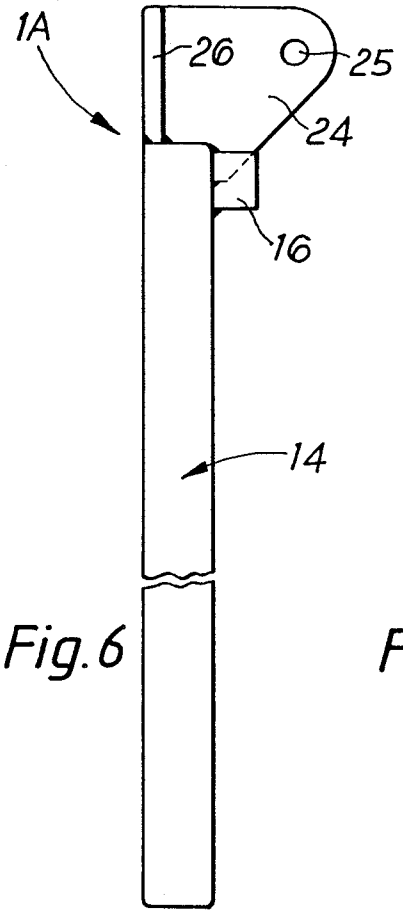
FIG. 6 is a n end elevation of FIG. 4 in the direction of arrow D.

A furnace panel 1 through which water as a coolant is adapted to flow, comprises coolant flow tubing, including a plurality of parallel tube lengths 2 each having a length approximating to the desired width of the panel, the parallel tube lengths 2 being stacked horizontally one above the other, to build up the panel 1 to a desired height, the panel 1 being rectangular with a top edge being defined by an uppermost tube length designated 2A and a bottom edge of the panel being defined by a lowermost tube length designated 2B, with the intermediate, parallel tube lengths designated 2. Each tube length 2, 2A, 2B is conveniently of 120×80×10 mm rectangular hollow section steel, comprising a top wall 3 located in a horizontal plane, a bottom wall 4 located in a parallel horizontal plane, a pair of spaced apart, parallel and vertical side walls 5, being a "hot" sidewall 5 adapted to face the furnace interior and a "cold" sidewall 6 remote from the furnace interior. Because of the superposition of the hot sidewalls 5, there is formed a generally flat and uninterrupted front face 7 to the panel, for efficient heat transfer, and similarly a back face 8. Each tube length 2, 2A, 2B is closed off by an end cap 9 welded in position, while, as indicated in FIG. 3, for convenience of construction, one end cap 8A is common to a pair of superposed tube lengths 2, 2A, 2B. Thus, when stacked one on top of the other, the external face of a bottom wall 4 of an upper parallel tube length 2A or 2 seats on the external face of a top wall 3 of an immediately lower parallel tube length 2 or 2B. The stacked tube lengths 2, 2A, 2B are secured to one another along mutually abutting or adjacent longitudinal edges, by welding at 10 at both the front face 7 and back face 8. The welding 10 is preferably continuous the entire length of each parallel tube length 2, 2A, 2B, and hence across the entire width of the panel, for maximum strength, although stitch welding is possible.

Each parallel tube length 2, has a water inlet aperture 11 and a water outlet aperture 12, whilst the uppermost tube length 2A has a water inlet 11A and a water outlet 12A in communication with a water conveying outlet pipe 13, and the lowermost tube length 2B has a water outlet 12B and a water inlet 11B in communication with a vertically extending, hollow, rectangular section inlet tube length 14 provided at one lateral side of the panel 1, corresponding in length to the height of the panel 1, and being secured by welding at 15 to adjacent ends/end caps 9, 9A of the tube lengths 2, 2A, 2B. The vertical tube length 14 is also provided with a cooling water inlet aperture 11C in communication with a water conveying inlet pipe 16 and a cooling water outlet aperture 12C in communication with the inlet aperture 11B of the lowermost tube length 2B, with a welded butt-joint 17 between the vertical inlet tube length 14 and the lowermost tube length 2B.

A pair of vertically spaced-apart support plates 18 having three spaced-apart support ribs 19 project rearwardly of the panel 1, the plates 18 being provided with a pair of apertures 20 by which the panel 1 is secured in its desired position by the apertures 20 being fitted onto locating pins (not shown) of the furnace structure.

The arrangement of water inlets and outlets in the various tube lengths 14, 2A, 2 and 2B is such that cooling water, pumped from a remote source, flows down the vertical tube length 14 as indicated by arrow 21 and into the lowermost tube length 2B as indicated by arrow 22. From the lowermost tube length 2B water passes successively from one tube length to the next above tube length through the stack, indicated by arrow 22, with the water flowing in opposite directions, through the remaining tube lengths 2, and lastly into the uppermost tube length 2A, water leaving the uppermost tube length 2A via its outlet aperture 12A and the outlet pipe 13.

Figure 1:
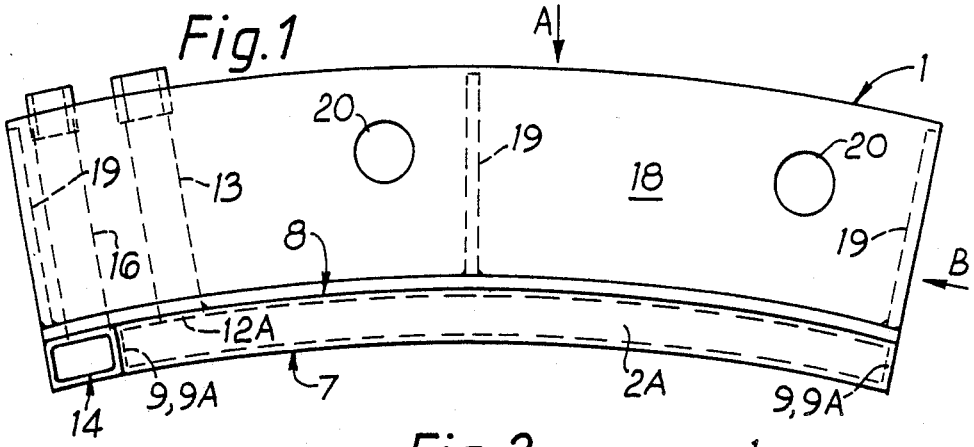
FIG. 1 is a plan view of a first embodiment of panel in accordance with the invention for use as a wall component of a circular, electric furnace.

As can be appreciated from FIGS. 1 and 3, the panel 1 is bent to arcuate shape so that it subtends an angle of 22° 30′ and hence sixteen such panels are required to define totally the inside of a circular, electric arc furnace.

Figure 2:
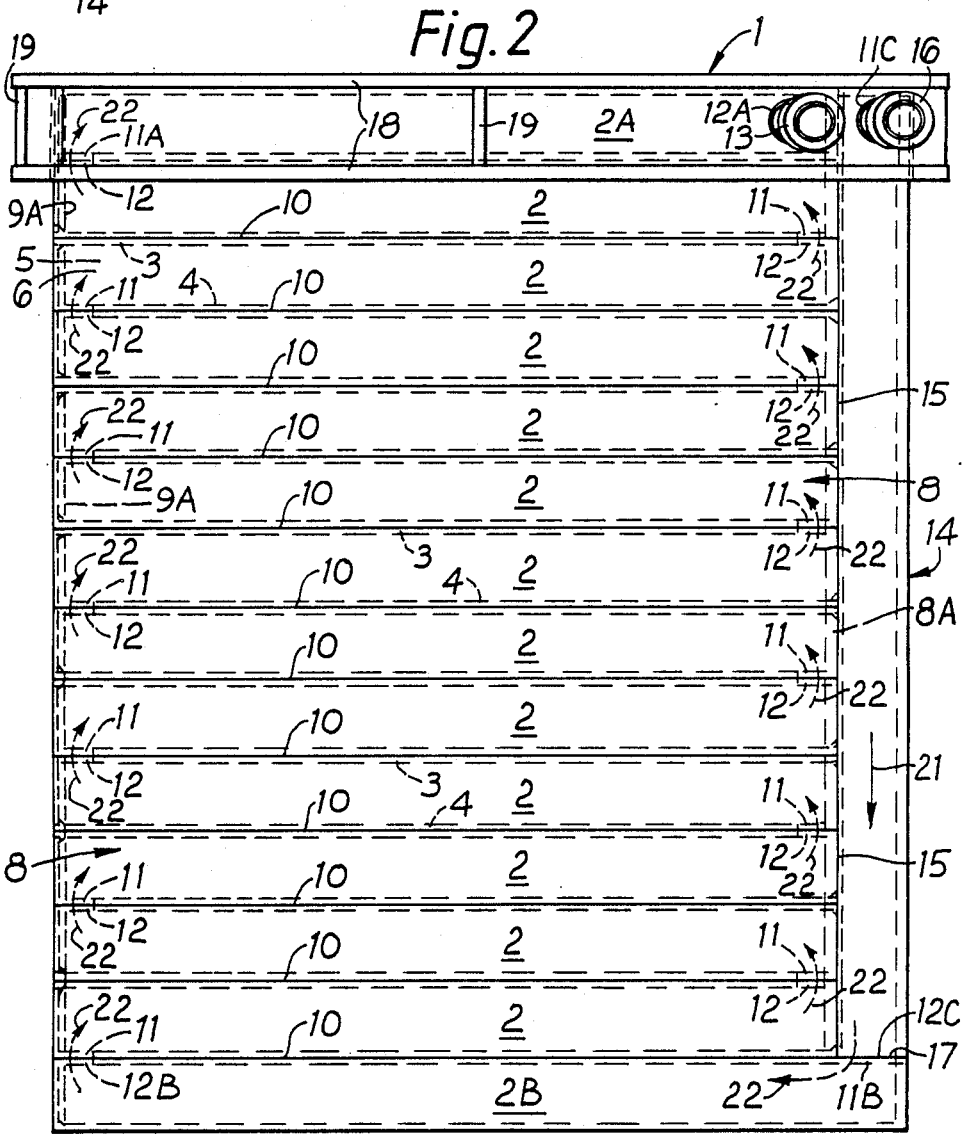
FIG. 2 is a view looking on the rear of the panel of FIG. 1 in the direction of arrow A.

The second embodiment of panel 1A illustrated in FIGS. 4–7, is intended for use as a slag door and is basically of the same construction as the panel 1 of FIGS. 1—3, but differs in that the panel 1A is flat, has a mitre joint 23 between the vertical inlet tube length 14 and the lowermost tube length 2B, and at its upper end has two spaced-apart pairs of apertured lugs 24 each having a hole 25 to receive a hinge pin (not shown), with a support plate 26 for the lugs 24, the latter and the support plate 26 being welded to the uppermost tube length 2A and the upper end of the vertical inlet tube length 14.

Figure 8:
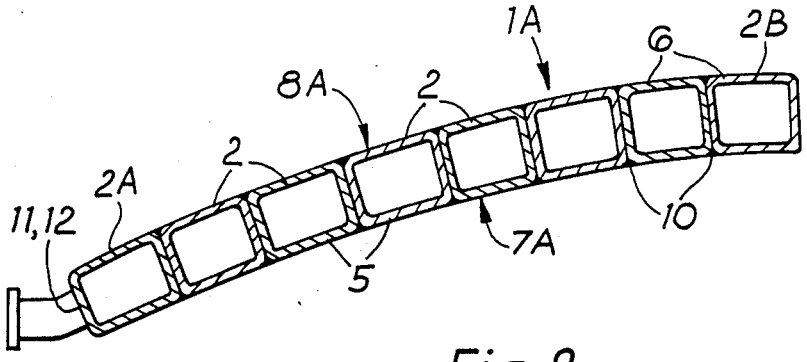
FIG. 8 is a sectional side elevation on the line VIII—VIII of FIG. 9 of a panel adapted to form part of a roof of an electric arc furnace.
Figure 9:
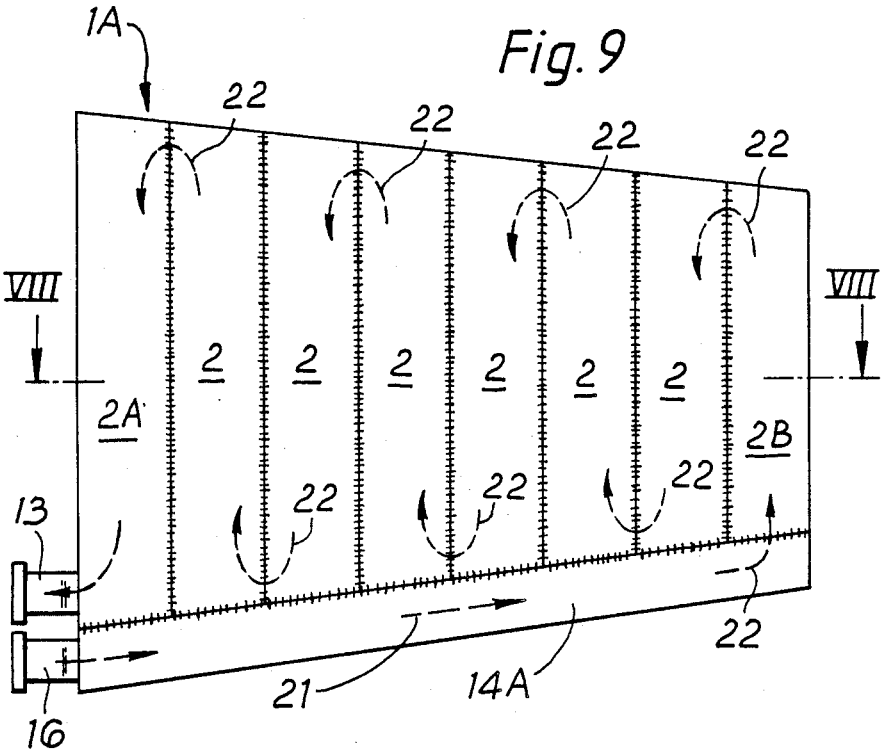
FIG. 9 is a plan view of the panel of FIG. 8.

In FIGS. 8 and 9 is indicated a modified panel 1A for use as part of a furnace roof, which panel is both segmental, as shown in FIG. 9, and curved, as indicated in FIG. 8 so that a plurality of such panels assembled end-to-end will define a circular roof of an electric arc furnace. Because of the side-by side relationship of the panels 2A, 2 and 2B, there is formed a curved and generally uninterrupted inner face 7A to the panel, and an outer face 8A. As before, a water inlet pipe is indicated at 16 and a water outlet pipe at 13, the water flow being along the inlet tube length 14A as indicated by arrow 21, then from the outer end of the inlet tube length into the tube length 2B, and then successively through the parallel tube lengths 2, 2A to the outlet pipe 13.

Panels in accordance with the invention could also be used in continuous casting plants and in rolling mills or other locations where thermal protection, e.g. of electric motors, is required.

What I claim is:

1. An electric arc furnace wall panel adapted the flow of coolant therethrough, having a coolant flow path defined by a plurality of elongate tube lengths having longitudinal axes and formed from hollow, rectangular rolled box section material, said tube lengths being stacked one on top of the other to create a wall panel of desired height, and said tube lengths being of the same pre-selected length to create a wall panel of desired width, with each of said tube lengths comprising four walls, being an inner "hot" wall adapted to face a furnace interior, an opposite and parallel outer "cold" wall, said inner and outer walls being interconnected by mutually spaced-apart, parallel abutment walls, with adjacent external surfaces of said abutment walls of adjacent tube lengths abutting one another, with adjacent tube lengths secured to one another by welding longitudinally along mutually adjacent corner zones defined between both said inner wall and said abutment wall, and between said outer wall and said abutment wall, with opposite ends of each said tube length closed off, and provided, adjacent both said ends of each of said tube lengths, with coolant flow apertures, said apertures communicating between adjacent tube lengths such that, in use, said coolant flows in at one end of each of said tube lengths, along said tube length, and out at the other end of each of said tube lengths, to and through successive tube lengths of said panel, and a coolant inlet tube length defining one lateral side of said panel being welded to ends of said stack of tube lengths at said lateral side of said panel, whereby said inlet tube length extends orthogonally with respect to said axes of said parallel tube lengths, with a coolant outlet aperture provided at a lower end of said inlet tube length and in fluid flow communication with a coolant inlet aperture of the lowermost of said stack of parallel tube lengths, with said inlet tube length disposed vertically and said coolant flow path being down said vertical tube length, into said lowermost of said parallel tube lengths and then, upwardly, in a zig-zag path, through successive ones of said parallel tube lengths, into long and out of an uppermost of said parallel tube lengths.

2. A panel as claimed in claim 1, wherein said tube lengths are located in abutting, side-by-side relationship, whereby said adjacent external faces are of adjacent end walls of a said adjacent tube lengths.

3. A panel as claimed in claim 1, of rectangular shape.

4. A panel as claimed in claim 1, of planar construction.

5. A panel as claimed in claim 1, of arcuate construction.

6. A panel as claimed in claim 5, wherein said panel subtends an angle of 22° 30′.

7. A panel as claimed in claim 5, wherein said panel is arcuate, so that a plurality of said panels, when assembled together end-to-end, form a circle to define an inner, circular wall of an electric arc furnace.

8. A panel as claimed in claim 1, wherein said panel is provided with a rear face, and a support plate and location apertures are provided on said support plate.

9. A panel as claimed in claim 1, comprising apertured lugs and a support plate.

10. A panel as claimed in claim 1, of such segmental shape, that a plurality of said panels, when assembled together end-to-end, form a circular roof of an electric arc furnace.

* * * * *